United States Patent [19]

Moriya et al.

[11] Patent Number: 4,462,894

[45] Date of Patent: Jul. 31, 1984

[54] PROCESS FOR PRODUCING PITCH FOR USING AS RAW MATERIAL FOR CARBON FIBERS

[75] Inventors: Kunihiko Moriya, Tokyo; Kazuhito Tate, Kanagawa; Goro Muroga, Tokyo; Kazuhiro Yanagida, Kanagawa, all of Japan

[73] Assignee: Mitsubishi Oil Co., Ltd., Tokyo, Japan

[21] Appl. No.: 409,216

[22] Filed: Aug. 18, 1982

[30] Foreign Application Priority Data

Aug. 18, 1981 [JP] Japan ..... 56-128141

[51] Int. Cl.[3] ..... C10C 3/06; C10G 45/00

[52] U.S. Cl. ..... 208/40; 208/71; 208/89; 208/92; 423/447.4

[58] Field of Search ..... 208/40, 92, 57, 71, 208/89; 423/447.1, 447.2, 447.4, 447.6, 449

[56] References Cited

U.S. PATENT DOCUMENTS

| | | | |
|---|---|---|---|
| 2,792,336 | 5/1957 | Kubicek et al. | 208/57 |
| 2,924,568 | 2/1960 | Anderson, Jr. et al. | 208/89 |
| 2,932,611 | 4/1960 | Scott, Jr. et al. | 208/92 |
| 2,945,803 | 7/1960 | Beuther et al. | 208/92 |
| 2,992,181 | 7/1961 | Kenner | 208/40 |
| 3,654,130 | 4/1972 | Voorhies et al. | 208/57 |
| 3,671,419 | 6/1972 | Ireland et al. | 208/92 |
| 3,767,741 | 10/1973 | Toyoguchi | 423/447.4 |
| 3,928,170 | 12/1975 | Takahashi et al. | 208/40 |
| 3,948,756 | 4/1976 | Wolk et al. | 208/57 |
| 3,974,264 | 8/1976 | McHenry | 423/447.4 |
| 3,976,729 | 8/1976 | Lewis et al. | 264/29.7 |
| 4,005,183 | 1/1977 | Singer | 423/447.4 |
| 4,026,788 | 5/1977 | McHenry | 208/39 |
| 4,048,057 | 9/1977 | Murphy | 208/89 |
| 4,115,527 | 9/1978 | Otani et al. | 423/447.4 |

FOREIGN PATENT DOCUMENTS

| | | | |
|---|---|---|---|
| 1544037 | 7/1957 | Canada | 208/57 |
| 1615444 | 2/1961 | Canada | 208/57 |
| 0054437 | 6/1982 | European Pat. Off. | 208/22 |
| 0063052 | 10/1982 | European Pat. Off. | 208/22 |

*Primary Examiner*—Delbert E. Gantz
*Assistant Examiner*—Helane E. Maull
*Attorney, Agent, or Firm*—Sughrue, Mion, Zinn, Macpeak, and Seas

[57] ABSTRACT

A process for producing a pitch is disclosed. The process involves distilling a heavy petroleum oil under reduced pressure to obtain a distillate, the distillate is hydrogenated to obtain a hydrogenated oil which is subjected to catalytic cracking. The cracked oil is subjected to distillation to obtain a high boiling point fraction having a boiling point of more than 300° C. The high boiling point fraction is subjected to thermal modification in order to obtain the pitch. The pitch can be utilized in order to produce carbon fibers of high quality. By utilizing the process a greater variety of starting materials can be utilized in order to produce the pitch which is utilized to produce high quality carbon fibers.

3 Claims, No Drawings

PROCESS FOR PRODUCING PITCH FOR USING AS RAW MATERIAL FOR CARBON FIBERS

FIELD OF THE INVENTION

The present invention relates to a process for producing pitch (which is a raw material for producing carbon fibers having a high modulus of elasticity), using a petroleum heavy residual oil.

BACKGROUND OF THE INVENTION

In pitches which are used as a raw material for producing carbon fibers having excellent strength and excellent modulus of elasticity, optical anisotropy is observed by a polarizing microscope. More specifically, such pitches are believed to contain a mesophase as described in U.S. Pat. No. 3,974,264. Further, it has recently been disclosed in Japanese Patent Application (OPI) 160427/79 (The term "OPI" as used herein refers to a "published unexamined Japanese patent application)" that carbon fibers having a high modulus of elasticity can be produced with a pitch containing a neomesophase. By heating such pitches for a short time optical anisotropy is observed in them. Further, pitches used as a raw material for carbon fibers need not possess only optical anisotropy but must also be capable of being stably spun. However, it is not easy to produce pitches having both properties. In order to produce carbon fibers having excellent strength and excellent modulus of elasticity, it is not always possible to use any material as the raw material for making pitches. Materials having specified properties have been required.

It should be noted that in many published patents, for example, as described in U.S. Pat. Nos. 3,976,729 and 4,026,788, the raw material is not specified in the claims of patent specifications. Furthermore, such patents indicate that pitches used as a raw material for carbon fibers can be produced only by carrying out thermal modification of a wide variety of raw materials. However, according to the detailed descriptions and examples in such patents the desired pitches can only be produced by using specified raw materials.

For example, U.S. Pat. No. 4,115,527 discloses that substances such as chrysene, etc. or tarry materials byproduced in high temperature cracking of petroleum crude oil are suitable for producing the pitch, i.e., a carbon fiber precursor, but conventional petroleum asphalts and coal tar pitches are not suitable. Further, U.S. Pat. No. 3,974,264 discloses that an aromatic base carbonaceous pitch having a carbon content of about 92 to about 96% by weight and a hydrogen content of about 4 to about 8% by weight is generally suitable for controlling a mesophase pitch. It has been described that elements excepting carbon and hydrogen, such as oxygen, sulfur and nitrogen, should not be present in an amount of more than about 4% by weight, because they are not suitable. Further, Example 1 of the same patent publication discloses that the precursor pitch used has properties comprising a density of 1.23 g/cc, a softening point of 120° C., a quinoline insoluble content of 0.83% by weight, a carbon content of 93.0%, a hydrogen content of 5.6%, a sulfur content of 1.1% and an ash content of 0.044%. Even if a density of 1.23 g/cc in these properties is maintained, it should be noted that it is difficult to obtain conventional petroleum heavy oil having such a high density. Examples as described in the other U.S. Pat. Nos. 3,976,729, 4,026,788 and 4,005,183 also disclose that the pitch is produced with a specified raw material.

The properties of heavy petroleum oils depend essentially upon the properties of crude oils from which they were produced and the process for producing the heavy oil. However, generally, it is rare that heavy oils having the suitable properties described in the above described Examples are produced, and, in many cases, they can not be obtained. Accordingly, in order to produce carbon fibers industrially in a stabilized state, which have excellent strength and excellent modulus of elasticity with petroleum heavy oils, it is necessary to develop a process for producing a pitch wherein the finally resulting pitch has properties which are always within a specified range even if the properties of the raw material for the pitch vary.

SUMMARY OF THE INVENTION

Therefore, one object of this invention is to provide a process for producing a pitch useful as raw material for carbon fibers having an excellent strength and a high modulus of elasticity.

Another object is to provide a process for producing a pitch which can be used for producing carbon fibers having the above excellent properties industrially in a stabilized state.

Still another object is to provide a process for producing a pitch used as raw material for carbon fibers with an easily available petroleum heavy residual oil.

These objects of this invention are effectively accomplished with a process for producing a pitch used as a raw material for carbon fibers which comprises carrying out hydrogenation treatment of a reduced pressure distillate oil prepared by reduced pressure distillation of a petroleum heavy residual oil, carrying out catalytic cracking, distilling the resulting cracking oil to take out a high boiling point fraction having a boiling point of more than 300° C., and carrying out thermal modification thereof.

DETAILED DESCRIPTION OF THE INVENTION

Examples of petroleum heavy residual oils which are used in the present invention include atmospheric pressure distillation residual oils and heavy residual oils from a thermal cracking process such as visbreaking etc. The petroleum heavy residual oils having a boiling point of more than 300° C. is preferred. The atmospheric pressure distillation residual oils are most commonly used.

The above described petroleum heavy residual oils are processed by a reduced pressure distillation apparatus to obtain a distillate fraction. 95% or more of the distillate fraction has a boiling point of 300° to 550° C. (atmospheric pressure). The resulting heavy fraction is subjected to hydrogenation treatment in the presence of a conventional hydrogenating catalyst (e.g., a catalyst containing the sulfides or oxides of such combination of metals as nickel-molybdenum, cobalt-molybdenum, etc.) at a temperature of 300°–410° C., a pressure of 40–150 kg/cm$^2$G, a liquid space velocity of 0.5–3.0 per hour, and a ratio of hydrogen/oil of 260–2,000 Nm$^3$/Kl. By carrying out this treatment impurities such as sulfur, nitrogen or metals are removed from the reduced pressure distillate oil. The resulting hydrogenated oil preferably has a sulfur content of not more than 0.4% by weight.

When producing carbon fibers having a high modulus of elasticity, it is necessary to remove sulfur in the pitch, because a high modulus of elasticity can not be obtained if the sulfur content of the pitch is large. It is preferred to remove the sulfur prior to the final step, because it is difficult to remove sulfur from the pitch in the final step. It is also necessary to remove metals which form ash by carbonization. Such metals can cause deterioration of the strength or modulus of elasticity of carbon fibers.

The above described hydrogenated oil is subjected to a catalytic cracking reaction in the presence of a catalytic cracking catalyst comprising amorphous silica-alumina, silica-magnesia or zeolite catalysts. The catalytic cracking reaction is carried out at a temperature of 470°-540° C., a pressure of 0.5-5.0 kg/cm$^2$G and a ratio of catalyst/oil of 5-15 parts by weight. A high boiling point fraction having a boiling point of more than 300° C. is obtained by distillation of the resulting cracking oil.

The resulting high boiling point fraction is subjected to thermal modification at a temperature of 390°-430° C. for 1-30 hours, by which a pitch which can be used as a raw material for making carbon fibers having a high modulus of elasticity can be produced. In the residual heavy fraction after the catalytic cracking reaction, the difference in properties due to any disparity in the raw material becomes smaller due to the effects of the catalytic reaction together with the above described hydrogenation treatment. Further, the residual heavy fraction developes a chemical composition comprising a large amount of aromatic compounds.

The actual conditions required to obtain the best results in the above described series of steps depend on the properties of the petroleum heavy residual oil which is used as a starting material as well as the properties of the pitch which will be used as a raw material for making carbon fibers as the final product. By carrying out a series of these steps any difference due to properties of the starting material becomes smaller. Therefore, by carrying out these steps, it is possible to keep the properties of the pitch which is used as a raw material for making carbon fibers within a specified range. Since the properties of the petroleum heavy residual oil (used as the starting material) are fairly different from others because of the crude oil, it is generally difficult to produce pitch (which can be successfully used to make carbon fibers having high strength and high modulus of elasticity and specified properties) by only carrying out the thermal modification of such petroleum heavy oil at 380° C. to 450° C.

However, in accordance with the present invention, a pitch which can be used as a raw material for carbon fibers having high modulus of elasticity can be produced industrially and stably with various kinds of petroleum heavy residual oils. The pitch is produced by carrying out a series of processings comprising reduced pressure distillation→hydrogenation treatment→catalytic cracking→distillation→thermal modification. By carrying out these steps it is possible to use a raw material which could not be used for producing a pitch for carbon fibers in accordance with prior processes.

In the following, the present invention is illustrated in greater detail by examples. However, this invention is not limited to these examples.

EXAMPLE 1

An atmospheric pressure distillation residual oil of Middle East crude oil (A) was subjected to reduced pressure distillation to obtain a fraction having a boiling point of 300°-550° C. (an atmospheric pressure). The resulting reduced pressure distillation fraction was subjected to hydrogenation treatment in the presence of a cobalt-molybdenum catalyst. The hydrogenation was carried out at a temperature of 370° C., a pressure of 60 kg/cm$^2$G, a liquid space velocity of 1.9 per hour and a ratio of hydrogen to oil of 360 Nm$^3$Kl. The hydrogenated oil was subjected to a catalytic cracking reaction with using a zeolite catalyst. The cracking was carried out at a temperature of 500° C., a pressure of 1.5 kg/cm$^2$G and a catalyst/oil ratio of 9 parts by weight. The residual heavy oil obtained from the catalytic cracking reaction was distilled to obtain a high boiling point fraction having a boiling point of more than 300° C. The high boiling point fraction was subjected to thermal modification at a temperature of 410° C. for 20 hours to obtain a pitch which could be used as a raw material for making carbon fibers.

The properties of the atmospheric distillation residual oil of Middle East crude oil (A) used as a raw material, and the properties of the oil after hydrogenation treatment, as well as the properties of the high boiling point fraction after catalytic cracking and the properties of the resulting pitch are shown in Table 1.

Carbon fibers were obtained by melt spinning the above described pitch at 360° C., infusiblizing at 260° C. in air and carbonizing at 1,000° C. The resulting carbon fibers had a tensile strength of 11 tons/cm$^2$ and a modulus of elasticity of 1,300 tons/cm$^2$. When carbonized fibers prepared by carbonizing at 1,000° C. were additionally graphitized at 1,900° C., the resulting carbon fibers had a tensile strength of 15 tons/cm$^2$ and a modulus of elasticity of 2,300 tons/cm$^2$.

EXAMPLE 2

An atmospheric pressure distillation residual oil of Middle East crude oil (B) was subjected to reduced pressure distillation to obtain a fraction having a boiling point of 300°-550° C. (an atmospheric pressure). The resulting reduced pressure distillation fraction was subjected to hydrogenation treatment in the presence of a cobalt-molybdenum catalyst. The hydrogenation was carried out at a temperature of 380° C., a pressure of 60 kg/cm$^2$, a liquid space velocity of 1.8 per hour and a ratio of hydrogen per oil of 400 Nm$^3$/Kl. The hydrogenated oil was subjected to a catalytic cracking reaction with a zeolite catalyst. The cracking was carried out at a temperature of 500° C. and a pressure of 1.5 Kg/cm$^2$ and a catalyst/oil ratio of 9 parts by weight. The residual heavy oil obtained from the catalytic cracking reaction was distilled to obtain a high boiling point fraction having a boiling point of more than 300° C. The high boiling point fraction was subjected to heat treatment at a temperature of 420° C. for 10 hours to obtain a pitch which could be used as a raw material for making carbon fibers.

The properties of the atmospheric pressure distillation residual oil of Middle East crude oil (B) used as the raw material, and the properties of the oil after hydrogenation treatment, as well as the properties of the high boiling point fraction after catalytic cracking treatment and properties of the pitch are shown in Table 1.

COMPARATIVE EXAMPLE 1

An atmospheric pressure distillation residual oil of Middle East crude oil (A) was subjected to thermal modification at a temperature of 410° C. for 18 hours. The properties of the atmospheric pressure distillation residual oil of Middle East crude oil (A) used as a raw material and the properties of the pitch are shown in Table 1.

Fibers were obtained by melt spinning the pitch at 350° C., infusiblizing in the air and carbonizing at 1,000° C. The fibers obtained had a tensile strength of 1.9 tons/cm$^2$ and a modulus of elasticity of 140 tons/cm$^2$.

COMPARATIVE EXAMPLE 2

An atmospheric pressure distillation residual oil of Middle East crude oil (A) was subjected to reduced pressure distillation to obtain a fraction having a boiling point in the range of 300°–550° C. The resulting reduced pressure distillation fraction was subjected to thermal modification at a temperature of 410° C. for 20 hours. The yield of the pitch obtained after the heat treatment was low and it was not possible to obtain the pitch in an amount necessary to examine its properties.

COMPARATIVE EXAMPLE 3

An atmospheric pressure distillation residual oil of Middle East crude oil (A) was subjected to reduced pressure distillation to obtain a fraction having a boiling point in the range of 300°–550° C. (an atmospheric pressure). The resulting reduced pressure distillation fraction was subjected to a catalytic cracking reaction using a zeolite catalyst. The cracking was carried out at a temperature of 500° C., a pressure of 1.5 kg/cm$^2$G and a catalyst/oil ratio of 9 parts by weight without the hydrogenation treatment. The residual heavy oil obtained by the catalytic cracking reaction was distilled to obtain a high boiling point fraction having a boiling point of more than 300° C. The high boiling point fraction was subjected to thermal modification at a temperature of 410° C. for 20 hours to obtain a pitch.

The properties of the atmospheric distillation residual oil of Middle East crude oil (A) used as a raw material, the properties of the high boiling point fraction after catalytic cracking as well as the properties of the resulting pitch are shown in Table 1.

The pitch obtained was subjected to melt spinning at about 365° C. However, the fiber obtained by the melt spinning broke frequently as compared with the pitch used as a raw material of Example 1. Accordingly, the melt spinning was very difficult to carry out. Further, the melt-spun fiber was infusiblized at 260° C. in the air and then carbonized at 1,000° C. The resulting product had a tensile strength of 9 tons/cm$^2$ and a modulus of elasticity of 1,010 ton/cm$^2$. When the carbonized fibers prepared by carbonized at 1,000° C. were additionally graphitized at 1,900° C., they had a tensile strength of 10 tons/cm$^2$ and a modulus of elasticity of 1,610 ton/cm$^2$.

TABLE 1

| Properties | Example 1 | Example 2 | Comparative example 1 | Comparative example 2 | Comparative example 3 |
|---|---|---|---|---|---|
| Properties of atmospheric distillation residual oil | | | | | |
| Specific gravity @ 15/4° C. | 0.969 | 0.990 | 0.969 | 0.969 | 0.969 |
| Kinematic viscosity @ 50° C. cSt | 770 | 2189 | 770 | 770 | 770 |
| Sulfur content - wt % | 2.9 | 4.3 | 2.9 | 2.9 | 2.9 |
| Residual carbon content wt % | 9.9 | 14.1 | 9.9 | 9.9 | 9.9 |
| Ash wt % | 0.01 | 0.01 | 0.01 | 0.01 | 0.01 |
| Properties after hydrogenation treatment | | | | | |
| Specific gravity @ 15/4° C. | 0.881 | 0.887 | | 0.915* | 0.915* |
| Kinematic viscosity @ 50° C. cSt | 15.2 | 16.3 | | 30.0* | 30.0* |
| Sulfur content wt % | 0.3 | 0.3 | | 1:8* | 1.8* |
| Residual carbon content wt % | 0.05 | 0.06 | | 0.27* | 0.27* |
| Ash wt % | 0.00 | 0.00 | | 0.00* | 0.00* |
| Properties of high boiling point fraction after catalytic cracking reaction | | | | | |
| Specific gravity @ 15/4° C. | 0.990 | 1.001 | | | 1.058 |
| Kinematic viscosity @ 50° C. cSt | 10.2 | 13.1 | | | 14.5 |
| Residual carbon content wt % | 1.9 | 2.0 | | | 5.2 |
| Sulfur content wt % | 1.2 | 1.4 | | | 2.7 |
| Carbon content wt % | 87.2 | 87.2 | | | 86.8 |
| Hydrogen content wt % | 10.9 | 10.6 | | | 9.6 |
| Properties of pitch | | | | | |
| Specific gravity @ 25/25° C. | 1.31 | 1.32 | 1.32 | | 1.32 |
| Softening point °C. | 330 | 330 | 320 | | 335 |
| Quinoline insoluble content wt % | 20.1 | 22.5 | 23.4 | | 24.0 |
| Spinnability | good | good | bad | | bad |

Note:
*properties after reduced pressure distillation

While the invention has been described in detail and with reference to specific embodiments thereof, it will be apparent to one skilled in the art that various changes and modifications can be made therein without departing from the spirit and scope thereof.

What is claimed is:

1. A process for producing a pitch for use as a raw material for carbon fibers, which comprises the steps of:

distilling a petroleum heavy residual oil under reduced pressure to produce a reduced pressure distillate oil, 95% or more of the distillate fractions thereof having a boiling point of 300° to 550° C. at atmospheric pressure;

hydrogenating the reduced pressure distillate oil in the presence of a hydrogenating catalyst at a temperature of 300° to 410° C., a pressure of 40 to 150 $kg/cm^2G$, a liquid space velocity of 0.5 to 3.0 per hour and a hydrogen/oil ratio of 260 to 2,000 $Nm^3/Kl$ to obtain a hydrogenated oil having a sulfur content of 0.4% by weight or less;

catalytically cracking the thus produced hydrogenated oil in the presence of a catalytic cracking catalyst at a temperature of 470° to 540° C., a pressure of 0.5 to 5.0 $kg/cm^2G$ and a catalyst/oil ratio of 5 to 15 parts by weight to obtain a cracked oil;

distilling the resulting cracking oil to produce a high boiling point fraction having a boiling point of greater than 300° C.; and thermally modifying the high boiling point fraction at a temperature of 390° to 430° C. for 1 to 30 hours to obtain a pitch.

2. A process for producing a pitch as claimed in claim 1, wherein the petroleum heavy residual oil is an atmospheric pressure distillation residual oil of crude oil.

3. A process for producing a pitch, as claimed in any of claims 1, or 2, wherein the catalyst utilized within the catalytic cracking is a catalyst selected from the group consisting of amorphous silica-alumina, silica-magnesia or zeolite catalysts.

* * * * *